United States Patent [19]

Hasegawa

[11] Patent Number: 4,700,890

[45] Date of Patent: Oct. 20, 1987

[54] PROTECTIVE DEVICE FOR SPRAYING APPARATUS

[75] Inventor: Kyohei Hasegawa, Nagaoka, Japan

[73] Assignee: Nippon Seiki Co., Ltd., Niigata, Japan

[21] Appl. No.: 826,914

[22] Filed: Feb. 6, 1986

[30] Foreign Application Priority Data

Oct. 31, 1985 [JP] Japan ..... 60-244995

[51] Int. Cl.[4] ..... B05B 1/28

[52] U.S. Cl. ..... 239/103; 239/122; 239/288.5; 239/332

[58] Field of Search ..... 239/120–122, 239/103, 288, 288.3, 288.5, DIG. 22, 332

[56] References Cited

U.S. PATENT DOCUMENTS

| | | | |
|---|---|---|---|
| 430,549 | 6/1890 | Thompson | 239/121 |
| 532,878 | 1/1895 | Holmes | 239/120 |
| 1,603,987 | 10/1926 | Schindler | 239/121 |
| 2,897,554 | 8/1959 | Myrick | 239/120 |
| 3,314,607 | 4/1967 | Copeland | 239/121 |
| 3,963,180 | 6/1976 | Wagner | 239/288.5 |
| 4,036,438 | 7/1977 | Soderlind et al. | 239/288.5 |
| 4,239,157 | 12/1980 | Fasth | 239/288.5 |
| 4,422,576 | 12/1983 | Saito et al. | 239/121 |

FOREIGN PATENT DOCUMENTS

| | | | |
|---|---|---|---|
| WO82/0037-99 | 11/1982 | PCT Int'l Appl. . | |
| 165445 | 2/1934 | Switzerland | 239/121 |
| 8602 | 5/1889 | United Kingdom | 239/122 |
| 2089688 | 6/1982 | United Kingdom . | |

*Primary Examiner*—Andres Kashnikow
*Assistant Examiner*—Michael J. Forman
*Attorney, Agent, or Firm*—Lowe Price LeBlanc Becker & Shur

[57] ABSTRACT

A protective cover for a spraying apparatus which sprays a liquid through a nozzle. The protective cover is capable of surrounding the high-pressure region of a ject of the liquid sprayed through the nozzle, and is provided in the inner circumference near the open end thereof with a drip preventing wall for preventing the drip of the liquid caused to adhere to the inner circumference of the protective cover. The liquid caused to adhere to the inner circumference of the protective cover flows along the inner circumference of the protective cover and is stopped by the drip preventing wall, and thereby the drip of the liquid is prevented satisfactorily.

4 Claims, 10 Drawing Figures

PROTECTIVE DEVICE FOR SPRAYING APPARATUS

BACKGROUND OF THE INVENTION

1. Field of the Invention

The present invention relates to improvements in a protective device for a liquid spraying apparatus.

2. Description of the Prior Art

U.S. Pat. Nos. 3,963,180 and 4,036,438 disclose spraying apparatus.

An exemplary conventional spraying apparatus as illustrated in FIGS. 9 and 10 comprises: a main housing 1, an electromagnetic driving unit 2 fixedly attached to the main housing 1, a grip 3 depending from the rear end of the main housing 1, a switch 4 held on the grip 3, a pump housing 1A fastened to the front end of the main housing 1 with screws 5, a cylinder 6 horizontally extending within the pump housing 1A, a piston 7 inserted from the rear end into the interior of the cylinder 6, a coil spring 8 interposed between the cylinder 6 and the piston 7 to resiliently bias the piston rearward, a cap 9 formed integrally with the pump housing 1A at the lower end of the pump housing 1A and provided with an internal thread 11, a container 10 for containing water, paint or the like, screwed on the cap 9, a suction pipe 14 fitted at the upper end thereof in a suction hole 12 extending through the pump housing 1A and the cap 9, a strainer 15 enclosing the suction opening of the suction pipe 14, a valve assembly including a valve 17, a coil spring 18 and a swirl chip 24 and attached to the front end of the pump housing 1A, a nozzle head 19 attached to the front end of the valve assembly, a conical protective cover 16 screwed on the nozzle head 19, a housing cover 1B fixed to the main housing 1 with screws 20 so as to cover the electromagnetic driving unit 2 and other parts provided within the main housing 1, and an adjusting screw 21 screwed into the main housing 1 and biased with a coil spring 22. The switch 4 is closed to apply an AC voltage to the solenoid 2A, and thereby the armature 2B of the electromagnetic driving unit 2 vibrates in horizontal directions. The piston 7 is reciprocated within the cylinder 6 by the combined action of the vibration of the armature 2B and the resilience of the coil spring 8. A discharge hole 13 is formed through the pump housing 1A and the cap 9. The amplitude of vibration of the armature 2B of the electromagnetic driving unit 2 can be adjusted by adjusting the gap between the front end of the adjusting screw 21 and a stopper 23 by turning the adjusting screw 21.

When the electromagnetic driving unit is energized, the armature 2B of the electromagnetic driving unit 2 is vibrated within the gap between the adjusting screw 21 and the stopper 23. The piston 7 is reciprocated within the cylinder 6 by the combined action of the coil spring 8 and the armature 2B. The liquid, such as water or paint, contained in the container 10 is sucked through the suction pipe 14 into the cylinder 6 by the reciprocation of the piston 7 during the suction stroke of the same. The liquid thus sucked into the cylinder 6 is compressed during the compression stroke of the piston 7 to open the valve 17 forcibly against the action of the coil spring 18, and thereby the liquid is sprayed through a nozzle hole 26 formed in the front wall 25 of the nozzle head 19.

This spraying apparatus jets the liquid through the nozzle hole 26 of the nozzle head 19 at a high pressure to form a high-pressure region in the vicinity of the nozzle hole 26. Therefore, it is possible that the hand is injured by a high-pressure jet of the liquid, when the hand is put accidentally into the jet of the liquid in the high-pressure region. In order to prevent such a danger, a protective cover 16 is provided so as to surround the nozzle hole 26, as shown in FIG. 10.

The protective cover 16 is formed in a skeleton framework so as to surround the jet of the liquid and to allow air to flow therethrough into the interior space thereof, and is provided with an air passage 26 to supply air to the jet of the liquid so that the jet of the liquid is sprayed without touching the inner surface of the protective cover 16. However, when the liquid is jetted out through the nozzle hole 26, a negative pressure is produced inside the protective cover 16 around the jet of the liquid, and thereby the liquid is caused to adhere to and drip along the inner surface of the protective cover 16.

SUMMARY OF THE INVENTION

Accordingly, it is an object of the present invention to provide a protective device for a spraying apparatus, capable of preventing the drip of the liquid.

The above and other objects, features and advantages of the present invention will become more apparent from the following description the preferred embodiment thereof taken in conjunction with the accompanying drawings.

BRIEF DESCRIPTION OF THE DRAWINGS

FIGS. 1 to 3 illustrate a first embodiment of the present invention, in which:

FIG. 1 is a fragmentary sectional view of the principal portion of a spraying apparatus, in which a protective cover is screwed on the pump housing of a pump unit;

FIG. 2 is a perspective view of the protective cover of FIG. 1; and

FIG. 3 is a front view of the protective cover of FIG. 1;

DETAILED DESCRIPTION OF THE PREFERRED EMBODIMENTS

Figure 1:
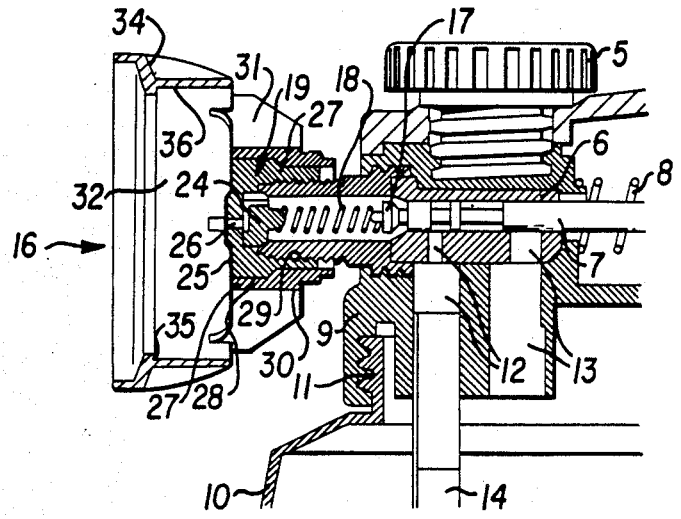

In FIGS. 1 to 10, like reference characters designate like or corresponding parts throughout.

Figure 2:
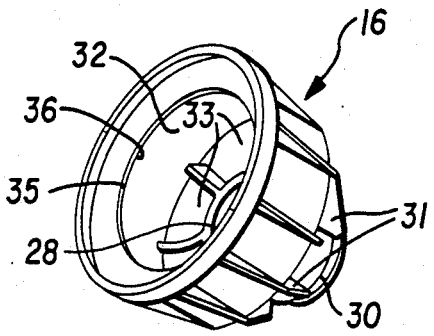
Figure 3:
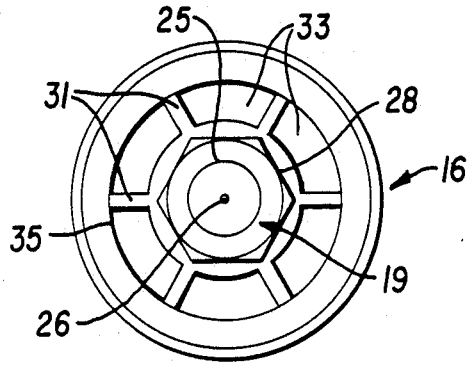

Referring to FIGS. 1 to 3 showing a first embodiment of the present invention, a valve 17, a coil spring 18 and a swirl chip 24 are provided in the front end of a pump housing 1A. A nozzle 19 is attached to the base end of a protective cover 16. A nozzle hole 26 is formed in the front wall 25 of the nozzle 19. The nozzle 19 has a cylindrical rear portion 27. A hexagon nut 28 is formed on the outer circumference of the cylindrical rear portion 27, while an internal thread 29 is formed in the inner circumference of the cylindrical rear end portion 27.

The protective cover 16 has a cylindrical base end 30 for receiving the nozzle 19 therein. In this embodiment, the nozzle 19 is incorporated into the protective cover 16 with the nut 28 thereof received in the cylindrical base end 30, through an insert molding process.

A plurality of joining pieces 31 are formed integrally with the cylindrical base end 30 at regular circumferential intervals so as to project radially outward from the cylindrical base end 30. A cylindrical cover 32 having a practically circular cross section is formed so as to extend forward from the foreparts of the joining pieces 31 along the axis of a jet of liquid. The spaces formed between the joining pieces 31 interconnecting the cylindrical base end 30 and the cylindrical cover 32 serve as air passages 33 through which air is allowed to pass from the exterior into the interior of the protective cover 16. An annular shoulder 34 is formed in the front portion of the cylindrical cover 32 to expand the open end of the cylindrical cover 32. The inner circumference of the annular shoulder 34 projects radially inward, namely, toward the center axis of a jet of liquid, to form a drip preventing wall 35. In this embodiment, a portion of the cylindrical cover 32 extending immediately behind the drip preventing wall 35, namely, a portion behind the drip preventing wall 35 on the side of the nozzle 19, serves as a liquid sump 36.

The liquid is sprayed by the pumping action of the spraying apparatus through the nozzle hole 26 in a mist having a divergent conical pattern without touching the inner circumference of the cylindrical cover 32 of the protective cover 16. However, some portion of the liquid sprayed through the nozzle 26 is caused to adhere to the inner circumference of the cylindrical cover 32 by a turbulent flow of air produced in the vicinity of the inner circumference of the protective cover 16. The liquid thus caused to adhere to the inner circumference of the cylindrical cover 32 flows down gradually along the inner circumference of the cylindrical cover 32 and stays in the liquid sump 36, and thereby the drip of the liquid from the protective cover 16 is prevented. The liquid collected in the liquid sump 36 is wiped off before using the spraying apparatus.

Figure 4:
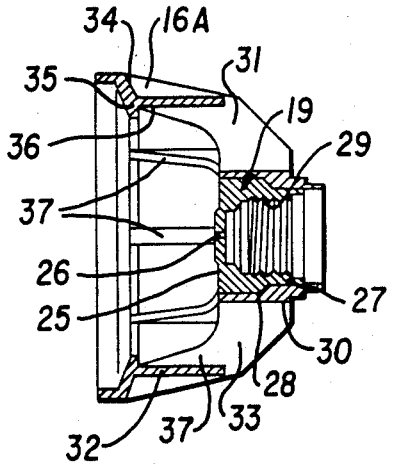
FIG. 4 is a sectional view of a protective cover, in a second embodiment, according to the present invention.
Figure 5:
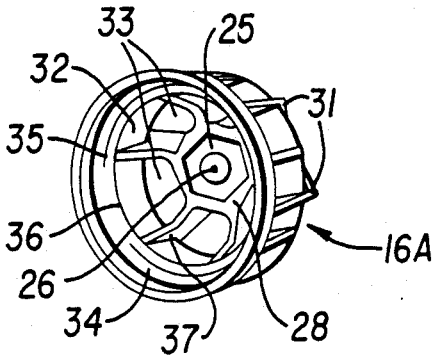
FIG. 5 is a perspective view of the protective cover of FIG. 4.

In a second embodiment shown in FIGS. 4 and 5, a nozzle 19 is incorporated integrally through insert molding process into an integral cylindrical base end 30 of a protective cover 16A. A plurality of joining pieces 31 are formed integrally with the cylindrical base end 30 at regular circumferential intervals so as to project radially outward from the cylindrical base end 30. A cylindrical cover 32 extending along the axis of a jet of liquid is joined to the foreparts of the joining pieces 31. Spaces formed between the joining pieces 31 interconnecting the cylindrical base end 30 and the cylindrical cover 32 serve as air passages 33. An annular shoulder 34 is formed in the front end of the cylindrical cover 32 to expand the open end of the cylindrical cover 32. The inner circumference of the shoulder 34 projects radially inward, namely, toward the center axis of the jet of liquid, to form an annular drip preventing wall 35. In this embodiment, a portion of the cylindrical cover 32 extending immediately behind the drip preventing wall 35, namely, a portion behind the drip preventing wall 35 on the side of the nozzle 19, serves as a liquid sump 36.

A plurality of ribs 37 are formed at regular circumferential intervals in the inner circumference of the cylindrical cover 32 at least so as to extend in the axial direction of the cylindrical cover 32 from the liquid sump 36.

The liquid is sprayed by the pumping action of the spraying apparatus through the nozzle hole 26 in a mist having a divergent conical pattern without touching the inner circumference of the cylindrical cover 32 of the protective cover 16A. However, some portion of the liquid sprayed through the nozzle 26 is caused to adhere to the inner circumference of the cylindrical cover 32 by a turbulent flow of air produced in the vicinity of the inner circumference of the protective cover 16A. The liquid thus caused to adhere to the inner circumference of the cylindrical cover 32 flows gradually downward in drops. However, the flow of the liquid is retarded by the radial ribs 37, and hence the flow speed of the liquid along the inner circumference of the cylindrical cover 32 is lower than that along the inner circumference of the cylindrical cover 32 of the first embodiment. The liquid is then collected in the liquid sump 36 of the cylindrical cover 32, and thereby the drip of the liquid is prevented.

Figure 6:
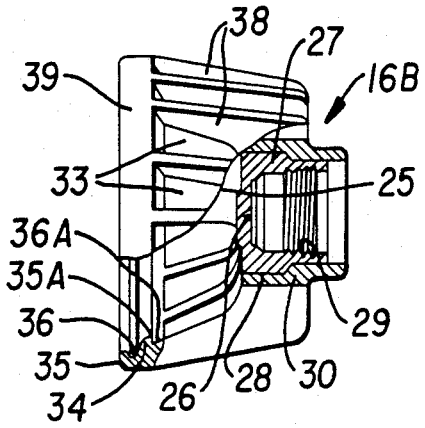
FIG. 6 is a partly sectional side elevation of a protective cover, in a third embodiment, according to the present invention.

In a third embodiment shown in FIG. 6, a nozzle 19 is incorporated integrally through insert molding process into an integral cylindrical base end 30 of a protective cover 16B. A plurality of radial ribs 38 are formed integrally with the cylindrical base end 30 with the roots thereof arranged at regular circumferential intervals along the outer circumference of the cylindrical base end 30. The radial ribs 38 extends along the axis of a jet of liquid in the spraying direction and the front ends of the radial ribs 38 emerge into an annular rib 39. Spaces between the radial ribs 38 serves as air passages 33. Front and rear annular drip preventing walls 35 and 35A are formed in the inner circumference of the annular rib 39 so as to project radially inward to form liquid sumps 36 and 36A in the inner circumference of the annular rib 39 behind the drip preventing walls 35 and 35A respectively.

Some portion of the liquid sprayed is caused to adhere to the inner surface of the radial ribs 38 by a turbulent flow of air produced in the vicinity of the inner circumference of the protective cover 16B. The liquid caused to adhere to the inner surface of the radial ribs 38 flows gradually along the inner surfaces of the radial ribs 38 toward the liquid sumps 36 and 36A and is collected in the liquid sumps 36 and 36A. Thus the drip of the liquid is prevented.

Figure 7:
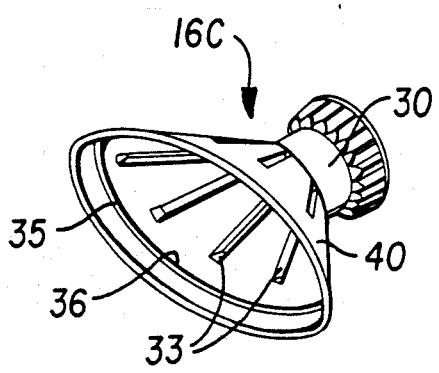
FIG. 7 is a perspective view of a protective cover, in a fourth embodiment, according to the present invention.

FIG. 7 shows a protective cover 16C, in a fourth embodiment, according to the present invention, for flat spraying by means of a nozzle 19 having a nozzle hole 26 having an elliptic cross section. The nozzle 19 is incorporated integrally through insert molding process into an integral cylindrical base end 30 of the protective cover 16C. A cover 40 having the shape of an elliptic cone expanding from the cylindrical base end 30 toward the exit end thereof if formed integrally with the cylindrical base end 30. Slits formed in the cover 40 along the generating lines serve as air passages 33. A drip preventing wall 35 projects radially inward, namely, toward the center axis of a jet of liquid, from the inner circumference near the brim of the cover 40. A liquid sump 36 is formed in a portion of the inner circumference of the cover 40 behind the drip preventing wall 35.

The liquid is sprayed by the pumping action of the spraying apparatus through the nozzle hole 26 in a mist in an elliptic spraying pattern. The liquid is sprayed without touching the inner circumference of the cover 40 of the protective cover 16C, however, some portion of the sprayed liquid is caused to adhere to the inner circumference of the cover 40. The liquid caused to adhere to the inner circumference of the cover 40 flows along the inner circumference of the cover 40 toward the drip preventing wall 35 and is collected in the liquid sump 36, and thereby the drip of the liquid is prevented.

Figure 8:
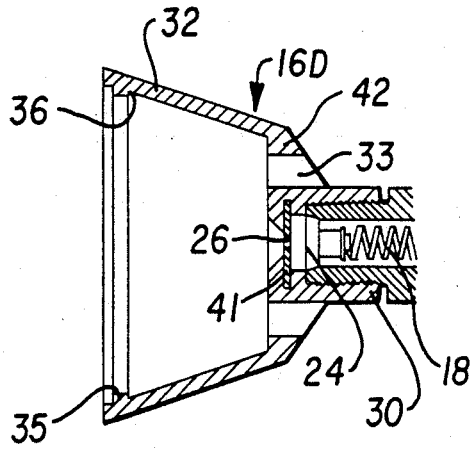
FIG. 8 is a sectional view of a protective cover, in a fifth embodiment, according to the present invention.
Figure 9:
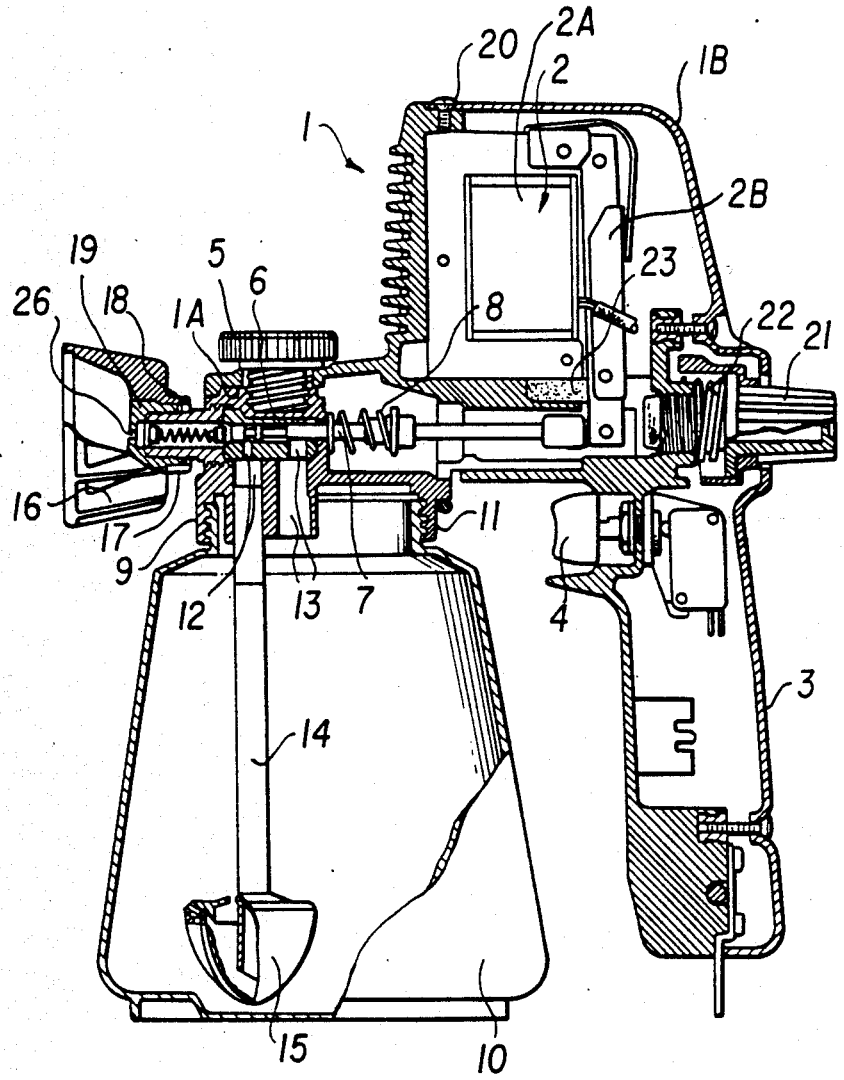
FIG. 9 PRIOR ART
FIG. 9 is a sectional view of a conventional common spraying apparatus to which a protective cover of the present invention is joined.
Figure 10:
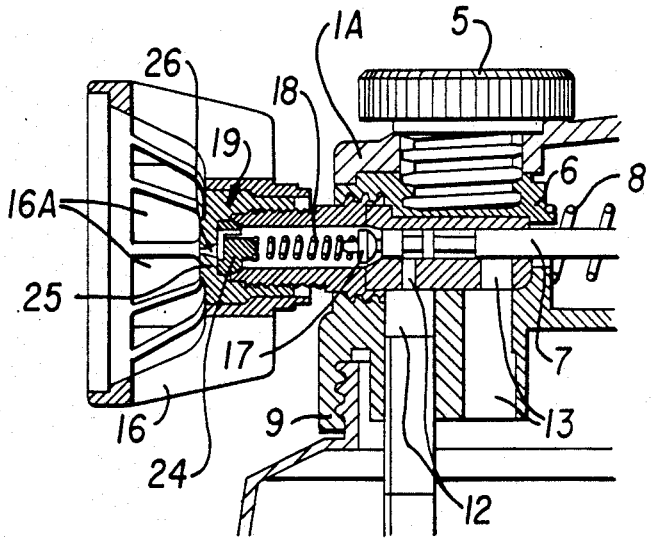
FIG. 10 PRIOR ART
FIG. 10 is a fragmentary sectional view of the principal portion of the sparying apparatus of FIG. 9 provided with a conventional protective cover.

FIG. 8 shows a fifth embodiment of the present invention. A valve 7, a coil spring 18 and a swirl chip 24 are provided in the front end of a pump housing 1A.

A flat nozzle plate 41 is incorporated integrally through insert molding process into a cylindrical base end 30 of a protective cover 16D in the front end of the cylindrical base end 30. An internal thread 29 is formed in the cylindrical base end 30. A conical flange 42 having air passages 33 is formed in the front end of the cylindrical base end 30 and a cylindrical cover 32 extends along the axis of a jet of liquid from the conical flange 42. The cylindrical base end 30, the conical flange 42 and the cylindrical cover 32 are formed in a unitary member. An annular drip preventing wall 35 is formed so as to protrude radially inward from the inner circumference of the cylindrical cover 32 near the brim of the cylindrical cover 32 and a liquid sump 36 is formed in the inner circumference of the cylindrical cover 32 behind the drip preventing wall 35. When the liquid is sprayed, some portion of the sprayed liquid is caused to adhere to the inner circumference of the cylindrical cover 32 by a turbulent flow of air produced in the vicinity of the inner circumference of the cylindrical cover 32. The liquid thus caused to adhere to the inner circumference of the cylindrical cover 32 flows gradually downward along the inner circumference of the cylindrical cover 32 in drops into the liquid sump 36, and thereby the drip of the liquid is prevented.

Although the present invention has been described with reference to preferred embodiments thereof, the present invention is not limited thereto and many changes and variations are possible without departing the scope thereof. For example, the shape, number and disposition of the drip preventing wall may be appropriately and selectively decided taking into consideration the type of the protective cover, and the nozzle may be incorporated into the base end of the protective cover by force fit instead of by insert molding.

Naturally, the present invention is applicable to an electric spraying apparatus provided with an electromagnetic driving unit as explained with reference to the preferred embodiments, and also to various spraying apparatus, such as an electric spraying apparatus which uses compressed air supplied from an air compressor, for the same effects as those described with reference to the preferred embodiments.

What is claimed is:

1. In spraying apparatus having an electromagnetic driving unit and a pump housing in a main body thereof, which sucks and sprays a liquid, the improvement comprising:

a protective cover having cylindrical base means at one end thereof for receiving a nozzle therein and a cylindrical cover extending forwardly from the cylindrical base means in a spraying direction, an annular drip preventing wall protruding radially inward from an inner circumference surface at a forward end of said cylindrical cover, a liquid sump being formed on a side of said annular drip preventing wall facing the base means to sump liquid adhering to the inner circumference surface of said cylindrical cover during a spraying operation, and air passages formed at the cylindrical cover to supply air into the cylindrical cover, said passages and forward end of the cylindrical cover being arranged to define a spray pattern substantially out of contact with said drip preventing wall, and further including ribs formed radially inward on the inner circumference surface of said cylindrical cover and extending axially in the direction of liquid spray from the wall towards the base means to sump liquid from the inner circumference surface of said cylindrical cover towards said liquid sump.

2. Spraying apparatus according to claim 1, wherein the protective cover has a substantially circular cross section.

3. Spraying apparatus according to claim 1, wherein the protective cover has an elliptical cross section.

4. Spraying apparatus according to claim 3, wherein the nozzle has a cross section which is elliptic.

* * * * *